United States Patent [19]

Tsubota et al.

[11] 4,054,456

[45] Oct. 18, 1977

[54] DIAZO PHOTOGRAPHIC MATERIALS CONTAINING 2-HYDROXY 3-NAPHTHANILIDE COUPLER

[75] Inventors: Motohiko Tsubota; Taiichi Nishimura; Kinji Ohkubo, all of Minami-ashigara, Japan

[73] Assignee: Fuji Photo Film Co., Ltd., Minami-ashigara, Japan

[21] Appl. No.: 608,374

[22] Filed: Aug. 27, 1975

Related U.S. Application Data

[63] Continuation of Ser. No. 353,193, April 20, 1973, abandoned.

[30] Foreign Application Priority Data

Apr. 21, 1972 Japan ..... 47-40204

[51] Int. Cl.[2] ..... G03C 1/58

[52] U.S. Cl. ..... 96/91 R; 96/49; 260/560

[58] Field of Search ..... 96/91 R, 75, 49; 260/560

[56] References Cited

U.S. PATENT DOCUMENTS

| | | | |
|---|---|---|---|
| 2,298,444 | 10/1942 | Weissberger et al. | 96/91 R |
| 2,405,523 | 8/1946 | Sease et al. | 96/91 R |
| 2,893,866 | 7/1959 | Haefeli | 96/91 R |
| 3,052,542 | 9/1962 | Sulich | 96/91 R |
| 3,064,049 | 11/1962 | Cox | 96/91 R |
| 3,373,021 | 3/1968 | Adams et al. | 96/75 |
| 3,573,051 | 3/1971 | Gray | 96/91 R |
| 3,585,033 | 6/1971 | Desjarlais | 96/91 R |
| 3,591,381 | 7/1971 | Gray et al. | 96/91 R |
| 3,619,191 | 11/1971 | Desjarlais | 96/91 R |
| 3,679,421 | 7/1972 | Kasper | 96/91 R |
| 3,847,983 | 11/1974 | Kobayashi et al. | 96/91 R |

OTHER PUBLICATIONS

Dinaburg, M. S., "Photosensitive Diazo Compounds," The Focal Press, 1965, p. 105.

Landau, R., "Fascicules 9217," Andrews Paper & Chem. Co. Inc., 1962, p. 65.

*Primary Examiner*—Charles L. Bowers, Jr.

*Attorney, Agent, or Firm*—Sughrue, Rothwell, Mion, Zinn and Macpeak

[57] ABSTRACT

Pure-blue images are obtained by developing a diazo photographic material containing a photosensitive diazonium compound in the presence of a coupler capable of forming a blue dye by coupling with the photosensitive diazonium compound, the coupler being represented by the general formula

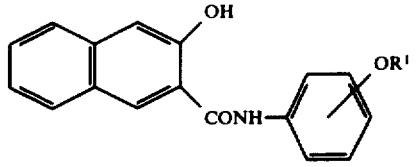

wherein $R_1$ represents

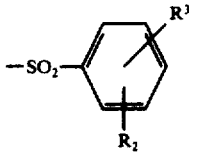

(wherein $R_2$ and $R_3$ each represents a hydrogen atom, a halogen atom or an alkyl group having 1–4 carbon atoms), —$COR_4$ (wherein $R_4$ represents an alkyl group having 1–4 carbon atoms or substituted or unsubstituted phenyl group, or

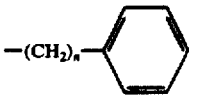

(wherein *n* represents 1 or 2) or by the general formula

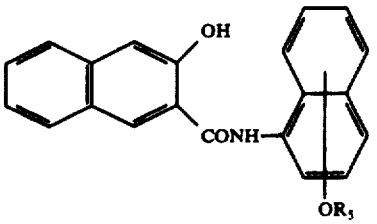

wherein $R_5$ represents a hydrogen atom, an alkyl group having 1–4 carbon atoms or

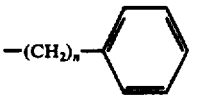

(wherein *n* represents 1 or 2).

7 Claims, No Drawings

DIAZO PHOTOGRAPHIC MATERIALS CONTAINING 2-HYDROXY 3-NAPHTHANILIDE COUPLER

This is a continuation, of application Ser. No. 353,193, filed Apr. 20, 1973, now abandoned.

BACKGROUND OF THE INVENTION

1. Field of the Invention

The present invention relates to diazo photographic materials containing a novel coupler and to a process of developing diazo photographic materials, particularly to a process of developing diazo photographic materials for providing improved blue images.

2. Description of the Prior Art

The formation of dye images utilizing a photosensitive diazonium compound is generally conducted by a photographic process where the diazonium compound is uniformly distributed over the surface of a support, the diazonium compound layer is exposed imagewise to light to destroy the diazonium compound at the exposed areas, and then the photosensitive diazonium compound remaining at the unexposed areas of the surface is caused to undergo a coupling reaction with a so-called "coupler" capable of forming a dye by reaction with the diazonium compound under an alkaline atmosphere. Dye images are thus formed on the photographic material.

Since a diazo photographic process can be operated very simply, the duplication speed thereof is high, the image quality obtained by the process is good, the cost for the process is low, images of various colors can be obtained by the process and such a process is quite suitable as a document or image duplicating means. However, in conventional techniques for the process it is difficult or frequently impossible to form dyes having a desired color hue or color purity. This is because there are not sufficient kinds of proper diazonium compounds and couplers which are raw materials for dyes. Accordingly, it is necessary to increase the kinds of both materials so that the diazo photographic process can be applied to all the desired fields.

SUMMARY OF THE INVENTION

The inventors have made studies for obtaining dyes having a color hue close to pure blue by the diazo photographic process based on the fact that with regard to couplers forming blue dyes, known couplers cannot give dyes showing a pure blue or a color close to pure blue, and the blue dyes formed from such known couplers are purplish or red-purplish, and as a result thereof, the novel coupler, elements and process of this invention have been attained.

That is to say, according to the present invention, there is provided a novel coupler and diazo photographic material and a process of developing diazo photographic materials which comprises developing diazo photographic materials containing at least one photosensitive diazonium compound in the presence of at least one compound represented by general formula I

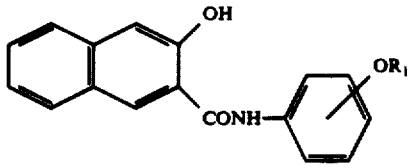

wherein $R_1$ represents

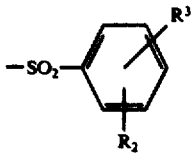

(wherein $R_2$ and $R_3$ each represents a hydrogen atom, a halogen atom, or an alkyl group having 1–4 carbon atoms), —$COR_4$ (wherein $R_4$ represents an alkyl group having 1–4 carbon atoms or a substituted or unsubstituted phenyl group (where most preferred substituents on the substituted phenyl are hydroxy, halogen, nitro, alkyl (most preferably $C_1$–$C_4$), aryl, most preferably monoaryl, e.g., phenyl, aralkyl (where most preferably the alkyl moiety is $C_1$–$C_4$ and the aryl group is phenyl), and the like), or

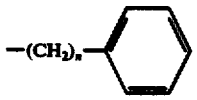

(wherein *n* represents 1 or 2) and/or one or more compounds represented by the general formula

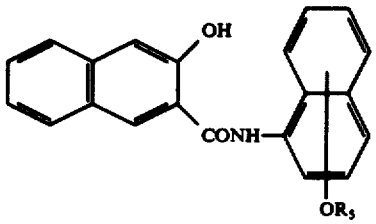

wherein $R_5$ represents a hydrogen atom, an alkyl group having 1–4 carbon atoms or

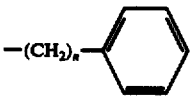

(wherein *n* represents 1 or 2).

This invention will be explained below in detail.

DETAILED DESCRIPTION OF THE INVENTION

Diazo photographic processes which are the background for the developing process for diazo photographic material according to this invention can be classified into many systems. In the 1st system amoung them a photosensitive diazonium compound is coated on a support to provide a photographic material, and after image exposing the photographic material the diazonium compound layer is developed in a developer containing a coupler to cause the reaction of both components and to form dye images. In the 2nd system, a two-component type photosensitive diazo composition containing a a photosensitive diazonium compound and a coupler is coated on a support to prepare a photographic material and, after image exposure, the photographic material is exposed to an alkaline atmosphere, such as ammonia gas, ammonia vapor or liquid ammonia, to cause the reaction of the diazonium compound and the coupler and to form dye images. In a specific embodiment of the 2nd system, an alkali forming material, i.e., a material which forms an alkaline material when decomposed, is incorporated in the photosensitive layer of the photographic material and, after image exposure, the photosensitive layer is heated to provide an alkaline atmosphere for developing the layer. Furthermore, there is a system in which a photographic material having a photosensitive layer of the same composition as above is heated imagewise to form an alkaline atmosphere at the heated portions only, whereby dye images are formed, and thereafter the diazonium compound remaining at the non-heated portions of the layer is destroyed by active rays to form stable images (i.e., if the photographic material thus developed is thereafter heated further, the dye images are not destroyed). These systems are called "heat developable diazo photographic processes."

The developing process of this invention can be applied to any systems of the aforesaid diazo photographic processes. That is to say, in the case of the 1st system as mentioned above, the coupler specified in this invention is incorporated in a developer, while in other systems the coupler is incorporated in the photosensitive layers of photographic materials. Also, the coupler may be incorporated in both the developer and the photosensitive layers in the present invention.

The photosensitive diazonium compounds used in the present invention are not special and they may be selected from diazonium compounds usually used in photosensitive diazonium compositions for making diazo photographic materials. Examples of such diazonium compounds are those represented by the general formula

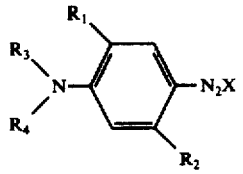

wherein $R_1$ and $R_2$ each represents a hydrogen atom; an alkoxy group having 1–4 carbon atoms, such as a methoxy group, an ethoxy group and a butoxy group; a lower alkyl group such as a methyl group, an ethyl group and a propyl group; a lower hydroxyalkyl group such as a 2-hydroxyethyl group; a lower hydroxyalkoxy group such as a 2-hydroxypropoxy group, a 3-hydroxypropoxy group and a 4-hydroxybutoxy group; an alkoxyalkoxy group such as a 2-ethoxyethoxy group, a 2-ethoxypropoxy group and a 3-ethoxybutoxy group; a cycloalkoxy group such as a cyclopentyloxy group and a cyclohexyloxy group, a halogen atom such as a chlorine atom and a bromine atom; or a carboxyl group; $R_3$ and $R_4$ each represents an alkyl group, an aralkyl group, a hydroxyalkyl group or an atomic group necessary for completing a heterocyclic nucleus selected from a pyrrolidine nucleus, a morpholine nucleus, a thiomorpholine nucleus, a piperidine nucleus, a piperazine nucleus, a 1,3-oxazolidine nucleus and an oxazino nucleus; and X represents an anion, for instance, a salt such as zinc chloride, boron tetrafluoride, hydrogen sulfate and phosphorus hexafluoride and the like.

In the above formula I, any alkyl moiety, e.g., alkyl group or alk(yl)oxy, most preferably has 1–6 carbon atoms and any lower alkyl group or moiety most preferably has 1–4 carbon atoms, unless otherwise indicated. Generally speaking, the exact number of alkyl carbon atoms is not overly critical, but compounds with very long chain alkyl moieties are more difficult to synthesis on an industrial scale.

Additional useful diazonium salts are described in "Photosensitive Diazo Compounds (Focal Press (1964))" written by M. S. Dinaburg and in "Light-Sensitive Systems", pages 194–320 (John Wiley & Sons (1965)) writted by J. Kosar.

Among the described diazonium salts, those compounds represented by the following general formula are most preferred.

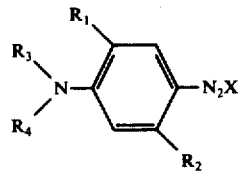

wherein $R_1$ and $R_2$ each represents a hydrogen atom; an alkoxy group such as methoxy, ethoxy, and butoxy, etc., group, most preferably alkoxy of 1–4 carbon atoms; a lower alkyl group such as methyl, ethyl, propyl and the like; a lower hydroxyalkyl group such as 2-hydroxyethyl and the like; a lower hydroxyalkoxy group such as 2-hydroxypropoxy; 3-hydroxypropoxy, 4-hydroxybutoxy and the like; an alkoxyalkoxy group such as 2-ethoxyethoxy, 2-ethoxypropoxy, 3-ethoxypropoxy group and the like; a cycloalkyloxyl group such as cyclopentaoxy, cyclohexaoxy and the like; a halogen atom such as chlorine and bromine; a carboxyl group, etc., wherein $R_3$ and $R_4$ represent an alkyl group, an aralkyl group, a hydroxyalkyl group or the atoms necessary to complete a heterocyclic ring nucleus, e.g., a pyrrolidine nucleus, a morpholine nucleus, a thiomorpholine nucleus, a piperidine nucleus, a piperazine nucleus, a 1,3-oxazolidine nucleus, an oxazino nucleus and the like, and wherein X represents an anion, for example, an acid residue such as zinc chloride, boric tetrafluoride, hydrogen sulfate, phosphorus hexafluoride, etc.

Specific examples of the photosensitive diazonium compounds used in this invention include, for instance, 2-carboxy-4-dimethylaminobenzene diazonium chloride.zinc chloride complex salt, 3-chloro-4-diethoxyaminobenzene diazonium chloride.zinc chloride complex salt, 4-(N-benzyl-N-methyl)aminobenzene diazonium chloride.sulfate complex salt, 2-methyl-4-pyrrolidinobenzene diazonium tetrafluoroborate, 3-chloro-4-pyrrolidinobenzene diazonium chloride.zinc chloride complex salt, 2,5-dibutoxy-4-morpholinobenzene diazonium hexafluorophosphate, 2,5-dimethoxy-4-morpholinobenzene diazonium tetrafluoroborate, 2,5-diisopropoxy-4-morpholinobenzene diazonium tetrafluoroborate, 4-(N-benzyl)-2,5-dichloroaminobenzene diazonium sulfate complex salt, 4-(N-benzyl)-2,5-dichloroaminobenzene diazonium tetrafluoroborate, 3-ethoxy-4-thiomorpholinobenzene diazonium chloride.zinc chloride complex salt, 3-bromo-4-pyrrolidinobenzene diazonium chloride.sulfate complex salt, 5-sec-butoxy-2-methoxy-4-morpholinobenzene diazonium sulfate, 2-ethoxy-4-morpholino-5-n-pentoxybenzene diazonium hexafluorophosphate, 5-cyclopentyloxy-4-morpholino-2-isopropoxybenzene diazonium chloride.zinc chloride complex salt, 2-t-butoxy-5-cyclohexyloxy-4-morpholinobenzene diazonium hexafluoroborate, 5-sec-butoxy-4-morpholino-2-n-pentoxybenzene diazonium tetrafluoroborate, 2-cyclopentyloxy-4-morpholino-5-n-propoxybenzene diazonium hexafluorophosphate, 5-ethoxybenzene-2-cyclohexyloxy-4-morpholinobenzene diazonium sulfate, 4-oxazolidinobenzene diazonium chloride.zinc chloride complex salt, 4-(2-methyl-oxazolidino)benzene diazonium chloride.zinc chloride complex salt, 4-(tetrahydro-1,3-oxazino)benzene diazonium chloride.zinc chloride complex salt, 4-(tetrahydro-2-methyl-1,3-oxazino) benzene diazonium chloride.zinc chloride complex salt, 4-(4-methyl-3-oxazolidino)benzene diazonium chloride.zinc chloride complex salt, 4-(2-phenyl-oxazolidino)benzene diazonium chloride.zinc chloride complex salt, 4-(tetrahydro-2-phenyl-1,3-oxazino)benzene diazonium chloride.zinc chloride complex salt and 4-oxazolidino-2-methoxybenzene diazonium chloride.zinc chloride complex salt.

The most characteristic feature of this invention is to use the blue dye-forming coupler represented by the general formula I or II. In general formula I, examples of the groups represented by $R_1$ are;

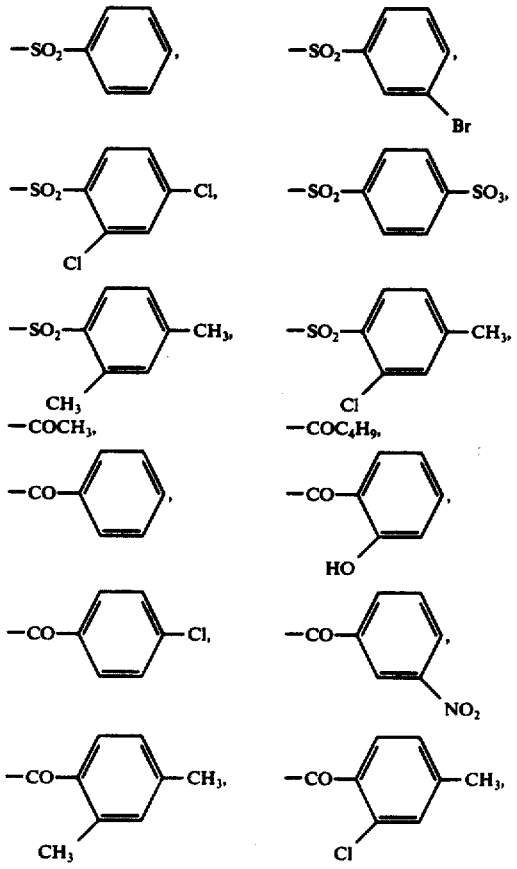

-continued

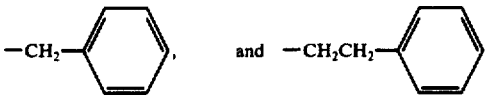

The group $—OR_1$ in general formula I may be introduced into any position of the benzene nucleus of the compound represented by the general formula I, regardless of $R_1$.

Specific examples of the compounds represented by the general formula I are 2-hydroxy-3'-(4''-methylbenzenesulfonyloxy)-3-naphthanilide,
2-hydroxy-2'-benzenesulfonyloxy-3-naphthanilide,
2-hydroxy-4'-(2'',4''-dimethylbenzenesulfonyloxy)-3-naphthanilide,
2-hydroxy-2'-(3''-bromobenzenesulfonyloxy)-3-naphthanilide,
2-hydroxy-4'-(4''-t-butylbenzenesulfonyloxy)-3-naphthanilide,
2-hydroxy-2'-(4''-methylbenzenesulfonyloxy)-3-naphthanilide,
2-hydroxy-3'-(2''-ethylbenzenesulfonyloxy)-3-naphthanilide,
2-hydroxy-4'-(2''-chloro-4'-methylbenzenesulfonyloxy)-3-naphthanilide,
2-hydroxy-2'-acetyloxy-3-naphthanilide,
2-hydroxy-3'-butyloyloxy-3-naphthanilide,
2-hydroxy-4'-(2''-hydroxybenzoyloxy)-3-naphthanilide,
2-hydroxy-4'-benzyloxy-3-naphthanilide,
2-hydroxy-3'-(4''-chlorobenzoyloxy)-3-naphthanilide,
2-hydroxy-2'-benzyloxy-3-naphthanilide and
2-hydroxy-4'-phenethyloxy-3-naphthanilide.

On the other hand, $R_5$ in general formula II is a hydrogen atom; an alkyl group such as a methyl group, an ethyl group, an n-propyl group, an iso-propyl group, an n-butyl group, an iso-butyl group, a sec-butyl group, a t-butyl group, etc.; a benzyl group; or a phenethyl group. The substituent $—OR_5$ containing an atomic group such as the above may be introduced at any position of the naphthalene nucleus of the compound of the general formula II, regardless of the $R_5$ group. Specific examples of compounds of general formula II are;

N-(2'-hyhdroxy-1'-naphthyl)-2-hydroxy-3-naphthamide,
N-(4'-methoxy-1-naphthyl)-2-hydroxy-3-naphthamide,
N-(5'-ethoxy-1'-naphthyl)-2-hydroxy-3-naphthamide,
N-(6'-benzyloxy-1'-naphthyl)-2-hydroxy-3-naphthamide,
N-(5'-n-butoxy-1'-naphthyl)-2-hydroxy-3-naphthamide,
N-(5'-hydroxy-1'-naphthyl)-2-hydroxy-3-naphthamide,
N-(7'-phenethyloxy-1'-naphthyl)-2-hydroxy-3-naphthamide,
N-(7'-hydroxy-1'-naphthyl)-2-hydroxy-3-naphthamide, and
N-(8'-hydroxy-1'-naphthyl)-2-hydroxy-3-naphthamide.

The compounds shown by general formula I or II can be prepared by condensing 2-hydroxynaphthoic acid and 1-aminonaphthalene derivatives or aniline derivatives. The production of the compounds will be illustrated by the following specific synthesis examples:

SYNTHESIS EXAMPLE 1

0.1 mol of 1-amino-2-naphthol hydrochloride and 0.1 mol of triethylamine were refluxed in 400 ml of acetonitrile and then 400 ml of a benzene solution of 0.1 mol of 2-hydroxynaphthoic acid chloride was added to the mixture followed by further refluxing for 4 hours. Thereafter, the solvent was distilled away, the residue was dissolved in a mixture of ether and ethyl acetate to form a solution, and after washing the solution with water, an organic solution layer thus formed was separated. The solvent was concentrated and the crystals thus formed were recovered by filtration. The crystals recovered were confirmed to be N-(2'-hydroxy-1'-naphthyl)-3-hydroxy-2-naphthamide, melting at 240°-242° C.

SYNTHESIS EXAMPLE 2

0.1 mol of 2-benzyloxyaniline was dissolved in 400 ml of acetonitrile and, while refluxing, 400 ml of a benzene solution of 0.1 mol of 3-hydroxy-2-naphthoic acid chloride was added to the mixture followed by further refluxing for 5 hours. The solvent was distilled off and the crystals formed were recovered and recrystallized from dioxane. The crystals were confirmed to be 3-hydroxy-2'-benzyloxy-2-naphthanilide, melting at 184° C.

The synthesis procedure generally described in U.S. Pat. No. 3,847,983 filed Oct. 5, 1972, can also be used to form the naphthanilide and anilide couplers within the present invention.

The diazo photographic materials used in this invention can contain and additives used for producing usual diazo photographic materials. In the case of incorporating the coupler in the diazo photographic material, a coupling inhibitor such as citric acid, tartaric acid, boric acid, oxypyridine and oxybenzotriazole may be incorporated therein for preventing the occurence of the coupling reaction of the diazonium salt and the coupler before development. The coupling inhibitor is used in an amount as is generally used in this art, usually from $5 \times 10^{-3}$ to $5 \times 10^{-2}$ moles of inhibitor per mole of diazonium salt.

Besides the above-mentioned acid stabilizer, an intensifier such as ammonium sulfate, zinc chloride, magnesium chloride and nickel sulfate; a stabilizer such as thiourea and thiosinamine; a development accelerator such as 1-allyl-β-hydroxyethyl-thiourea and 1-allyl-thiourea; a moisture absorbent such as glycol and glycerol; a wetting agent such as saponin, lauryl sulfate and oleyl-N-methyltaurine; a binder such as gelatin, polyvinyl alcohol, starch, polyvinyl acetate and gum arabic; and a pigment such as silica and alumina may also be incorporated in the diazo photographic materials. These materials are used in amounts as are common in the art, e.g., in moles per mole of diazonium salt

| | |
|---|---|
| intensifer | $5 \times 10^{-3} - 5 \times 10^{2}$ mole; |
| stabilizer | $1 \times 10^{-2} - 9.2 \times 10^{2}$ mole; |
| development accelerator | $10^{-3} - 10^{2}$ mole; |
| moisture absorbent | $10^{-5} - 10$ mole; |
| wetting agent | $10^{-4} - 10^{2}$ mole. |

The photosensitive diazo composition for the diazo photographic material are applied to a base or support, preferably as a homogeneous solution or a dispersion. In the case of using a dispersion, polycarbonate, regenerated cellulose, a polyester such as polyethylene terephthalate, a cellulose ester such as cellulose acetate butyrate, cellulose diacetate, and cellulose triacetate, or another synthetic resin is used as the binder therefor. The binders in the preceeding paragraph may also be so used. That is to say, the abovementioned photosensitive diazo composition is dispersed in a solution of the above-mentioned resin, preferably a synthetic resin, in an organic solvent. Generally speaking when a binder is used the weight ratio of diazonium salt to binder is from about $10^{-4}$ to about $10^{2}$ parts binder: 1 part diazonium salt. As can be seen from the breadth of this range the weight ratio is not overly critical and can be freely selected to obtain any desired layer strength. It is best to use a thin binder layer, and generally excellent results are obtained when the thickness is about $1.3 \times 10^{-3}$ to about $9.8 \times 10^{3}\mu$. Any binder as is used in the diazo art may be appropriately selected for use in the present invention.

As the organic solvent used in this case, there are illustrated alcohols such as methanol, ethanol, propanol and isopropanol; ketones such as acetone, diethylketone and methyl ethyl ketone; ethers such as ether, isopropyl ether, ethyleneglycol monomethyl ether and ethyleneglycol monoethyl ether; esters such as ethyl acetate; and hydrocarbons such as benzene, toluene, cyclohexane, chloroform and methylene chloride.

As the base for the diazo photographic materials used in this invention, there are illustrated polycarbonate films, regenerated cellulose films, films of polyesters such as polyethylene terephthalate, films of cellulose esters such as cellulose acetate butyrate, cellulose diacetate and cellulose triacetate, films of other plastics and papers. The bases may, if desired, be subjected to a surface treatment. For instance, the surface of a cellulose triacetate film can be subjected to a saponification treatment.

The coated amount of the aforesaid photosensitive diazo composition can be more than $10^{-4}$ millimol/m$^2$ as photosensitive diazonium compound, but is preferably more than 0.2 millimol/m$^2$. Generally speaking, no improvement in results is obtained by using more than 2 millimols/m$^2$ as compared to 2 millimols/m$^2$, as photosensitive diazonium compound.

In the case of incorporating the coupler in a diazo photographic material in this invention, the proper amount of the coupler added is 0.01-10 mols per mol of the photosensitive diazonium compound. In case of incorporating the coupler in a developer, the amount of the coupler can be more than about $10^{-4}$ mol per mol of the photosensitive diazonium compound contained in the diazo photographic material to be developed in the developer.

When the coupler is contained in the developer, most preferably from $10^{-2}$ to $10^{-2}$ moles of coupler per mole of the photosensitive diazonium compound is used. The developing solution which contains the coupler can be freely selected from those in the art, so long as, of course, the developer contains no components which might degrade the coupler. For example, a typical developer comprises the following components:

| | |
|---|---|
| Water | 50 ml |
| Methanol | 30 ml |
| Isopropanol | 20 ml |
| Thiourea | 1.0 g |
| Potassium boric acid | 7.2 g |
| Potassium hydroxyside | 0.8 g |

The components of common developing solutions used with good results are described in "Photosensitive Diazo Compounds", Focal Press Co., Ltd. (1964), written by M. S. Dinabury and in "High-Sensitive Systems", John Wiley & Sons (1965), written by J. Kosar.

Generally speaking, as the developer, in the case of the coupler being present in the developer, the alkali treating solutions described above can be used, and the in case of ammonia, ammonia gas and/or liquid ammonia can be used.

In case of using ammonia gas, atmospheric pressure or super atmospheric pressure can be used, with typical commercial developments being at 6 atmospheres. In the case of using liquid ammonia, the liquid ammonia can be freely mixed with water, and developing solutions including ammonia gas and liquid ammonia systems can be heated, with the temperature generally being 0° C - 100° C, with room temperature or above being best for non-ammonia alkali systems.

The treating time is preferably 1 second - 5 minutes for the development, and is merely conducted until the desired image density is obtained.

The photosensitive diazo composition shows colored dye images having an accurate color hue necessary for making blue image duplications by the process of this invention, and the blue image obtained contains no undesirable red-purple or purple color.

The coupler used in this invention has high solubility in the coating solutions used to form the photosensitive layer as compared with conventional couplers, and thus sufficient image density can be obtained using such a coupler. Such a discovery is quite astonishing, considering the fact that couplers similar to the coupler of this invention have the faults as mentioned above.

The invention will now be illustrated in greater detail by the following examples.

EXAMPLE 1

The photosensitive liquid having the following composition was coated uniformly on a transparent cellulose triacetate film having a thickness of 150 microns so that the coated amount became 27 cc/m²

| | |
|---|---|
| Methyl ethyl ketone | 60 ml |
| Methanol | 30 ml |
| Sulfosalicylic acid | 2.0 g |
| Formic acid | 10 ml |
| 3-Hydroxy-2-(p-toluenesulfonyloxy)-2-naphthanilide | 1.6 g |
| 2-Methyl-4-pyrrolidinylbenzene diazonium chloride zinc chloride complex salt | 1.5 g |

After drying, the photographic film thus prepared was exposed behind a transparent orignal to ultraviolet rays and then brought into contact with ammonia vapor at 80° C for 30 seconds. The print obtained showed good blue hue.

On the other hand, when 1.2 g of 3-hydroxy-2'-methyl-2-naphthanilide was used in the same procedure as above in place of the 3-hydroxy-2'-(p-toluenesulfonyloxy)-2-naphthanilide, a very reddish red-purple was obtained.

Furthermore, when the same procedure as above was followed using 3-hydroxy-3'-(p-toluenesulfonyloxy)-2-naphthanilide in place of 2-hydroxy-2'-(p-toluenesulfonyloxy)-2-naphthanilide, an image or print having a good blue-purple color was obtained.

EXAMPLE 2

As in Example 1, a photosensitive film was prepared by coating uniformly on the same base to the same thickness the photosensitive liquid having the following composition and drying:

| | |
|---|---|
| Methyl ethyl ketone | 60 ml |
| Methanol | 30 ml |
| Sulfosalicylic acid | 2.0 g |
| Formic acid | 10 ml |
| 3-Hydroxy-2-acetyloxy-2-naphthanilide | 1.2 g |
| 2,5-Dibutoxy-morpholinobenzene diazonium tetrafluoroborate | 2.1 g. |

The photographic film thus prepared was exposed behind a transparent orignal to ultraviolet rays and then brought into contact with ammonia vapor as in Example 1. Thus, a print having a good blue hue was obtained.

Also, when the same amount of 3-hydroxy-2'-benzyloxy-2-naphthanilide or 3-hydroxy-4'-benzyloxy-2-naphthanilide was used in place of the 3-hydroxy-2'-acetyloxy-2-naphthanilide, a print having a good blue hue was obtained.

EXAMPLE 3

Following the same procedures of Example 1, a photosensitive film (a) was prepared by coating a photosensitive liquid having the following composition and drying:

| | |
|---|---|
| Methanol | 60 ml |
| Methyl ethyl ketone | 30 ml |
| Sulfosalicylic acid | 2.0 g |
| Formic acid | 10 ml |
| 3-Hydroxy-3'-(p-toluenesulfonyloxy)-2-naphthanilide | 1.5 g |
| 4-Morpholino-2,5-dibutoxybenzene diazonium chloride . zinc chloride complex salt | 1.5 g |

Furthermore, in the same way as above, photosensitive films (B), (C), (D) and (E) were prepared using the following couplers, respectively, in place of 3-hydroxy-2'-(p-toluenesulfonyloxy)-2-naphthanilide, in the amounts given below:

| | | |
|---|---|---|
| (B): | 3-Hydroxy-2-benzenesulfonyloxynaphthanilide | 1.5 g, |
| (C): | 3-Hydroxy-4'-(2'',4''-dimethylbenzenesulfonyloxy)-2-naphthanilide | 1.8 g, |
| (D): | 3-Hydroxy-2'-(3''-bromo benzenesulfonyloxy)-2-naphthanilide | 1.5 g |
| (E): | 3-Hydroxy-N,N-di(hydroxyethyl)-2-naphthamide | 1.2 g |

Each of these photographic films was exposed and developed as in Example 1. The colors of the images obtained are shown in the following table.

| Film | (A) | (B) | (C) | (D) | (E) |
|---|---|---|---|---|---|
| Color | Blue | Blue | Blue-purple | Blue | Red-purple |

As is clear from the results, when the conventional coupler was used, an image have quite a reddish red-purple color was obtained, while in case of using the couplers in this invention, good blue images were obtained.

EXAMPLE 4

A photosensitive film (A) was prepared by coating the photosensitive liquid having the following composition and drying as in Example 1:

| | |
|---|---|
| Methanol | 60 ml |
| Methyl ethyl ketone | 30 ml |
| Sulfosalicylic acid | 2.0 g |
| Formic acid | 10 ml |
| 3-Hydroxy-2'-acetyloxy-2-naphthanilide | 1.6 g |
| 2,5-Dibutoxy-4-pyrrolidinylbenzene diazonium chloride . zinc chloride complex salt | 1.0 g |

Furthermore, photosensitive films (B), (C) and (D) were prepared in the same way using the following couplers in the amounts indicated, respectively, in place of 3-hydroxy-2'-acetyloxy-2-naphthanilide:

| | |
|---|---|
| (B): 3-Hydroxy-3'-(t-butyloxyloxy)-2-naphthanilide | 1.7 g, |
| (C): 3-Hydroxy-4'-(2''-hydroxybenzoyloxy)-2-naphthanilide | 1.7 g, |
| (D): 3-Hydroxy-N,N-di(hydroxyethyl)-2-naphthamide | 1.2 g. |

Each of the photosensitive films prepared as above was exposed and developed as in Example 1. The colors of the images obtained are shown in the following table.

| Film | (A) | (B) | (C) | (D) |
|---|---|---|---|---|
| Color | Blue-purple | Blue-purple | Blue-purple | Red |

From the above results, it will be understood that the image obtained using the conventional coupler shown above was red, while the images obtained using the couplers of this invention were good blue-purple in color.

EXAMPLE 5

As in Example 1, a photosensitive film (A) was prepared by coating a photosensitive liquid having the following composition and drying.

| | |
|---|---|
| Methanol | 60 ml |
| Methyl ethyl ketone | 30 ml |
| Sulfosalicylic acid | 2.0 g |
| Formic acid | 10 ml |
| 3-Hydroxy-2'-benzyloxy-2-naphthanilide | 1.6 g |
| 4-Morpholino-2,5-diisopropoxybenzene diazonium chloride . zinc chloride complex salt | 1.5 g |

Moreover, photosensitive films (B), (C), (D), (E) and (F) were prepared in the same was as above using the following couplers in the amounts indicated, respectively, in place of 3-hydroxy-2'-benzyloxy-2-naphthanilide:

| | |
|---|---|
| (B): 3-Hydroxy-4'-phenethyloxy-2-naphthanilide | 1.7 g, |
| (C): 3-Hydroxy-4'-benzoyloxy-2-naphthanilide | 1.7 g, |
| (D): 3-Hydroxy-3'-(4''-chlorobenzoyloxy)-2-naphthanilide | 1.8 g, |
| (E): 3-Hydroxy-2'-(3''-nitrobenzoyloxy)-2-naphthanilide | 1.8 g, |

-continued

| | |
|---|---|
| (F): 3-Hydroxy-N,N-di(hydroxyethyl)-2-naphthamide | 1.2 g. |

Each of the photosensitive films thus prepared was exposed and developed as in Example 1. The colors of the images obtained are shown in the following table.

| Film | (A) | (B) | (C) | (D) | (E) | (F) |
|---|---|---|---|---|---|---|
| Color | Blue | Blue-purple | Blue-purple | Blue-purple | Blue | Red-purple |

As is clear from the above results, it will be understood that the photosensitive film (F) containing the conventional coupler showed a reddish red-purple color, while the photosensitive films containing the couplers of this invention showed good colors of blue-purple to blue.

EXAMPLE 6

As in Example 1, a photosensitive film (A) was prepared by coating a photosensitive liquid having the following composition and drying:

Methanol
Methyl ethyl ketone
Sulfosalicyclic acid
Formic acid
3-Hydroxy-2'-(p-toluenesulfonyloxy)-2-naphthanilide
2,5-Dibutoxy-4-morpholinobenzene diazonium tetrafluoroborate Furthermore, photosensitive films (B), (C), (D) and (E) were prepared in the same way as above using the following couplers in the amounts shown, respectively, in place of 3-hydroxy-2'-(p-toluenesulfonyloxy)-2-naphthanilide:

| | |
|---|---|
| (B): 3-Hydroxy-4'-(4''-t-butylbenzenesulfonyloxy)-2-naphthanilide | 1.9 g |
| (C): 3-Hydroxy-3'-(2''-ethylbenzenesulfonyloxy)-2-naphthanilide | 1.6 g |
| (D): 3-Hydroxy-4'-(2''-chloro-4''-methylbenzenesulfonyloxy)-2-naphthanilide | 1.8 g |
| (E): 3-Hydroxy-N,N-di(hydroxyethyl)-2-naphthamide | 1.2 g |

Each of the photographic films thus prepared was exposed and developed as in Example 1. The colors of the images obtained are shown in the following table.

| Film | (A) | (B) | (C) | (D) | (E) |
|---|---|---|---|---|---|
| Color | Blue | Blue | Blue | Blue | Red-purple |

As is clear from the above results, it will be understood that photosensitive film (E) containing the conventional coupler showed a reddish red-purple color, while the photosensitive films containing the couplers of this invention showed a good blue color.

EXAMPLE 7

As in Example 1, a photosensitive film (A) was prepared by coating a photosensitive liquid having the following composition and drying:

| | |
|---|---|
| Methyl ethyl ketone | 60 ml |
| Methanol | 30 ml |

-continued

| | |
|---|---|
| Sulfosalicylic acid | 2.0 g |
| Formic acid | 10 ml |
| 3-Hydroxy-N-(2'-hydroxynaphthyl)-2-naphthamide | 2.0 g |
| 2-Methyl-4-pyrrolidinylbenzene diazonium chloride . zinc chloride complex salt | 1.5 g. |

Also, photosensitive film (B) was prepared in the same way as above using 3-hydroxy-2'-methyl-2-naphthanilide in place of 3-hydroxy-N-(2'-hydroxynaphthyl)-2-naphthamide. When each of the photosensitive films was exposed and developed as in Example 1, photosensitive film (A) showed a good blue color, while photosensitive film (B) gave a very reddish red-purple image.

Furthermore, the above procedure was tried using 3-hydroxy-N-(1'-naphthyl)-2-naphthamide in place of 3-hydroxy-N-(2'-hydroxynaphthyl)-2-naphthamide, but it was impossible to dissolve the desired amount of the conventional coupler, and hence the dye density of the film obtained by developing was inferior to the case of photosensitive film (A).

EXAMPLE 8

As in Example 1, a photosensitive film was prepared by coating a photosensitive liquid having the following composition and drying:

| | |
|---|---|
| Methyl ethyl ketone | 60 ml |
| Methanol | 30 ml |
| Sulfosalicylic acid | 2.0 g |
| Formic acid | 10 ml |
| 3-Hydroxy-N-(7'-hydroxy-naphthyl)-2-naphthamide | 2.0 g |
| 2,5-Dibutoxy-4-morpholino-benzene diazonium tetrafluoroborate | 2.1 g |

When this photosensitive film was exposed and developed as in Example 1, an image showing a good blue color was obtained. Also, since the solubility of the coupler used in this example was higher than 3-hydroxy-N-(1'-naphthyl)-2-naphthamide, the image obtained had sufficient image density.

EXAMPLE 9

As in Example 1, a photosensitive film was prepared by coating a photosensitive liquid having the following composition and drying:

| | |
|---|---|
| Methyl ethyl ketone | 60 ml |
| Methanol | 30 ml |
| Sulfosalicylic acid | 2.0 g |
| Formic acid | 10 ml |
| 3-Hydroxy-N-(5'-hydroxy-naphthyl)-2-naphthamide | 2.0 g |
| 2-Methyl-4-pyrrodinylbenzene diazonium tetrafluoroborate | 2.1 g. |

When this photosensitive film was exposed and developed as in Example 1, an image showing a good color hue was obtained. Also, since the solubility of the coupler used in this example was higher than that of 3-hydroxy-N-(1'-naphthyl)-2-naphthamide, the image had sufficient image density.

EXAMPLE 10

As in Example 1, a photosensitive film (A) was prepared by coating a photosensitive liquid having the following composition and drying:

| | |
|---|---|
| Methanol | 60 ml |
| Methyl ethyl ketone | 30 ml |
| Sulfosalicylic acid | 1.5 g |
| Formic acid | 10 ml |
| 3-Hydroxy-N-(4-methoxynaphthyl)-2-naphthamide | 1.6 g |
| 2,5-Dibutoxy-4-morpholinobenzene diazonium tetrafluoroborate | 1.4 g. |

Furthermore, photosensitive film (B) was prepared in the same manner as above using 1.8 g of 3-hydroxy-N-(5'-ethoxy-naphthyl)-2-naphthamide in place of the coupler of this invention used for producing film (A).

When each of the photosensitive films thus prepared was exposed and developed as in Example 1, photosensitive film (A) gave a good blue image and film (B) also gave a good blue-purple image. Both of the couplers used in this example had higher solubility in methanol than 3-hydroxy-N-(1'-naphthyl)-2-naphthamide, and sufficient image density was obtained in the both cases.

EXAMPLE 11

As in Example 1, a photosensitive film (A) was prepared by coating a photosensitive liquid having the following composition and drying:

| | |
|---|---|
| Methanol | 60 ml |
| Methyl ethyl ketone | 30 ml |
| Sulfosalicylic acid | 1.5 g |
| Formic acid | 10 ml |
| 3-Hydroxy-N-(6-benzyloxynaphthyl)-2-naphthamide | 1.8 g |
| 2,5-Diisobutoxy-4-morphilino-benzene diazonium chloride . zinc chloride complex salt | 1.6 g. |

Furthermore, photosensitive film (B) was prepared in the same manner as above using 1.9 g of 3-hydroxy-N-(5'-butoxynaphthyl)-2-naphthanilide in place of the coupler used for producing photosensitive film (A).

When each of the photosensitive films thus prepared was exposed and developed as in Example 1, both films (A) and (B) gave good blue-purple images.

Also, since both couplers used in this example had almost the same solubility in methanol as 3-hydroxy-N-(7'-hydroxynapthylyl)-2-naphthamide, sufficient image density was obtained in both cases.

EXAMPLE 12

As in Example 1, a photosensitive film (A) was prepared by coating a photosensitive liquid having the following composition and drying:

| | |
|---|---|
| Methanol | 60 ml |
| Methyl ethyl ketone | 30 ml |
| Sulfosalicylic acid | 1.5 g |
| Formic acid | 10 ml |
| 3-Hydroxy-N-(7'-phenethyloxy-naphthyl)-2-naphthamide | 1.9 g |
| 4-Pyrrolidinylbenzene diazonium chloride . zinc chloride complex salt | 1.0 g. |

Furthermore, photosensitive film (B) was prepared in the same way as above using 1.5 g of 3-hydroxy-N-(8'-hydroxynapthyl)-2-naphthamide in place of the coupler used for preparing film (A).

When each of the photosensitive films thus prepared was exposed and developed as in Example 1, both films (A) and (B) gave good blue-purple images. Also, since both couplers used in this example had higher solubility in methanol than 3-hydroxy-N-(1'-naphthyl)-2-naphthamide, sufficient image density was obtained in both cases.

EXAMPLE 13

A photosensitive liquid having the following composition was uniformly coated on the surface of a transparent cellulose triacetate film having a thickness of 150 microns in an amount of 27 cc/m²:

| | |
|---|---|
| Methanol | 60 ml |
| Methyl ethyl ketone | 30 ml |
| Sulfosalicylic acid | 2.0 g |
| Formic acid | 10 ml |
| 3-Hydroxy-2'-(p-toluenesulfonyl)-2-naphthanilide | 1.0 g |
| 4-(N-Benzyl-N-ethyl)amino-benzene diazonium chloride . zinc chloride complex salt | 1.5 g. |

After drying, the photosensitive film thus prepared was exposed behind a transparent original to ultraviolet rays and brought into contact with ammonia vapor. The print thus obtained showed good blue color.

On the other hand, when the same procedure as above was followed using 1.0 g of 3-hydroxy-N,N-di(-hydroxyethyl)-2-naphthamide in place of 3-hydroxy-2'-(p-toluenesulfonyloxy)-2-naphthanilide, a very reddish red-purple image was obtained.

Furthermore, when, in the same procedure as above, 1.8 g of 3-hydroxy-2'-acetyloxy-2-naphthanilide or 1.6 g of 3-hydroxy-4'-benzyloxy-2-naphthanilide was used in place of 3-hydroxy-2'-(p-tolueneulfonyloxy)-2-naphthanilide, good blue images were obtained in both cases.

EXAMPLE 14

A photosensitive liquid having the following composition was uniformly coated on the surface of a cellulose triacetate film having a thickness of 150 microns in a coated amount of 27 cc/m²:

| | |
|---|---|
| Gum arabic | 0.3 g |
| Tartaric acid | 0.5 g |
| Sodium naphthalene-1,3,6-trisulfonate | 4.0 g |
| 2,5-Dibutoxy-4-morpholinobenzene diazonium chloride . zinc chloride complex salt | 2.0 g |
| Water | 50 ml |
| Methanol | 50 ml. |

The photosensitive film thus prepared was exposed to a high pressure mercury lamp (1500 watts) for 3 seconds and then developed by coating a developer having the following composition on the surface of the film so that the coated amount of the liquid became 30 cc/m²:

| | |
|---|---|
| Water | 50 ml |
| Methanol | 50 ml |
| N-(2'-hydroxy-1-naphthyl)-2-hydroxy-3-naphthamide | 1.2 g |
| Thiourea | 1.5 g |
| Potassium tetraborate | 7.2 g |
| Potassium hydroxide | 0.8 g. |

Development was for 180 seconds at 25° C. After development, the treating solution was removed by heating at about 50° C.

The print thus obtained showed a good blue color hue.

Also, in the case of using 2 g of 3-hydroxy-2'-(p-toluenesulfonyloxy)-2-naphthanilide, or using 2.2 g of 2-hydroxy-2'-(3''-bromobenzenesulfonyloxy)-3-naphthanilide, or using N-(6'-benzyloxy-1'-naphthyl)-2-hydroxy-3-naphthamide in place of N-(2'-hydroxyl-1-naphthyl)-2-hydroxy-3-naphthamide in the above developer, good blue images were obtained in each case.

EXAMPLE 15

A photosensitive liquid having the following composition was coated on a cellulose acetate film having a thickness of 150 microns saponified to a depth of 5 microns in a coated amount of 27 cc/m²:

| | |
|---|---|
| Water | 50 ml |
| Methanol | 30 ml |
| Isopropanol | 20 ml |
| Tartaric acid | 0.5 g |
| Sodium naphthalene-1,3,6-trisulfonate | 3.5 g |
| Saponin | 0.1 g |
| 4-Morpholino-2,5-dipropoxybenzene diazonium tetrafluoroborate | 2.1 g. |

After drying, the photosensitive film was exposed behind a transparent original to a high pressure mercury lamp (1500 watts) for 5 seconds. Then, the film was developed by coating thereon a developer having the following composition so that the amount became 30 cc/m²:

| | |
|---|---|
| Water | 50 ml |
| Methanol | 50 ml |
| 2-Hydroxy-2'-benzyloxy-3-naphthanilide | 1.2 g |
| Thiourea | 0.8 g |
| Potassium tetraborate | 7.0 g |
| Potassium hydroxide | 0.8 g. |

The print obtained showed a good blue color hue.

Also, the same procedure as above was followed using 1 g of 2-hydroxy-2'-acetyloxy-3-naphthanilide, 1.4 g of 2-hydroxy-2'-(3''-nitrobenzoyloxy)-3-naphthanilide, 1 g of N-(7'-hydroxy-1'-naphthyl)-2-hydroxy-3-naphthamide or 1.9 g of N-(5'-butyroxy-1'-napthyl)-2-hydroxy-3-naphthamide in place of 2-hydroxy-2'-benzyloxy-3-naphthanilide. A good blue image was obtained in each case.

EXAMPLE 16

A photosensitive liquid having the following composition was coated on a polycarbonate film having a thickness of 150 microns so that the coated amount became 25 cc/m²:

| | |
|---|---|
| Water | 50 ml |
| Methanol | 50 ml |
| Gum arabic | 0.3 g |
| Sulfosalicylic acid | 1.0 g |
| Sodium 2,7-naphthalenedisulfonate | 3.6 g |
| 2,5-Dipentoxy-4-morpholinobenzene diazonium tetrafluoroborate | 2.2 g |
| 2-Hydroxy-4'-(2'',4''-dimethyl-benzenesulfonyloxy)-3-naphthanilide | 0.6 g. |

After drying, the photosensitive film prepared as above was image-exposed to a high pressure mercury lamp (1500 watts) for about 3 seconds and then developed by coating on the image-exposed film a developer having the following composition:

| | |
|---|---|
| Water | 50 ml |
| Methanol | 30 ml |
| Isopropanol | 20 ml |
| 2-Hydroxy-4'-(2'',4''-dimethyl-benzenesulfonyloxy)-3-naphthanilide | 0.6 g |
| Thiourea | 1.0 g |
| Potassium borate | 7.2 g |
| Potassium hydroxide | 0.8 g. |

The print thus obtained showed good blue color hue.

While the invention has been described in detail and with reference to specific embodiments thereof, it will be apparent to one skilled in the art that various changes and modifications can be made therein without departing from the spirit and scope thereof.

What is claimed is:

1. A diazo photographic material having a support with a stabilized photosensitive emulsion layer thereon which provides blue images containing, together with a photosensitive diazonium compound, at least one compound which forms a blue dye upon reaction with said photosensitive diazonium compound, which compound is represented by the general formula

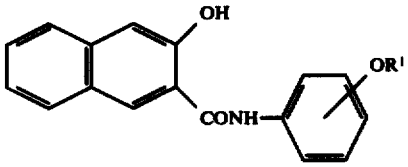

wherein $R_1$ represents (1)

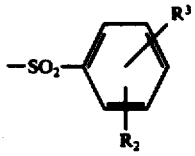

wherein $R_2$ and $R_3$ each represents a hydrogen atom, a halogen atom, or an alkyl group having 1–4 carbon atoms; or (2) —$COR_4$ wherein $R_4$ represents an alkyl group or a substituted phenyl group or unsubstituted phenyl group wherein said substituted phenyl group is substituted with one or more members from the group consisting of hydroxy, halogen, nitro, alkyl having 1–4 carbon atoms, aryl or aralkyl where the alkyl moiety has 1–4 carbon atoms.

2. A diazo photographic material as claimed in claim 1 wherein the amount of said compound incorporated in the photosensitive emulsion layer is 0.01–10 mols per mol of said photosensitive diazonium compound.

3. A diazo photographic material as claimed in claim 2 where the diazo photographic material comprises a support, and the amount of photosensitive diazonium compound is more than $10^{-4}$ millimol/m² of support.

4. A diazo photographic material as claimed in claim 3 where the amount of photosensitive diazonium compound is from 0.2 millimol/m² of support to 2 millimol/m² of support.

5. A diazo photographic material as claimed in claim 3 where the diazonium compound is one or more materials selected from there of the general formula:

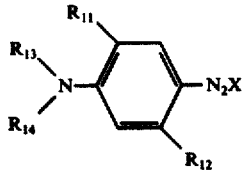

wherein $R_{11}$ and $R_{12}$ each represents a hydrogen atom; an alkoxyl group having 1–4 carbon atoms; a lower alkyl group; a lower hydroxyalkyl group; a lower hydroxyalkoxyl group; an alkoxyalkoxy group; a cycloalkoxy group; a halogen atom; or a carboxyl group; $R_{13}$ and $R_{14}$ each represents an alkyl group, an aralkyl group, a hydroxyalkyl group or an atomic group necessary for completing a heterocyclic nucleus selected from a pyrrolidine nucleus, a morpholine nucleus, a thiomorpholine nucleus, a piperidine nucleus, a piperazine nucleus, a 1,3-oxazolidine nucleus and an oxazino nucleus; and X represents an anion.

6. A diazo photographic material as claimed in claim 1 wherein $R_1$ represents

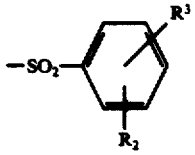

wherein $R_2$ and $R_3$ each represent a hydrogen atom, a halogen atom or an alkyl group having 1–4 carbon atoms.

7. A diazo photographic material as claimed in claim 1 wherein $R_1$ represents —$COR_4$ wherein $R_4$ represents an alkyl group.

* * * * *